US005990406A

United States Patent [19]

Nakamura et al.

[11] Patent Number: 5,990,406

[45] Date of Patent: Nov. 23, 1999

[54] EDITING APPARATUS AND EDITING METHOD

[75] Inventors: Junichi Nakamura, Chiba; Shuichi Ohtsu, Kanagawa; Shigeru Aoyagi, Kanagawa; Takashi Higuchi, Kanagawa, all of Japan

[73] Assignee: Sony Corporation, Tokyo, Japan

[21] Appl. No.: 09/204,296

[22] Filed: Dec. 3, 1998

[30] Foreign Application Priority Data

Dec. 12, 1997 [JP] Japan ..... 9-343312

[51] Int. Cl.[6] ..... G10H 1/26

[52] U.S. Cl. ..... 84/609; 84/645; 84/649

[58] Field of Search ..... 84/609–614, 634–638, 84/645, 649–652, 666–669

[56] References Cited

U.S. PATENT DOCUMENTS

| | | | |
|---|---|---|---|
| 5,313,012 | 5/1994 | Ishida | 84/609 |
| 5,747,716 | 5/1998 | Matsumoto | 84/609 |
| 5,859,379 | 1/1999 | Ichikawa | 84/609 |

*Primary Examiner*—Stanley J. Witkowski
*Attorney, Agent, or Firm*—Jay H. Maioli

[57] ABSTRACT

Correct musical performances are played back at edit points by inserting an event specifying a sound source at each of the edit points, by inserting edit-point denoting events each for denoting one of the edit points, and by inserting an edit-point control event for controlling the edit points during work to edit a standard MIDI file.

10 Claims, 13 Drawing Sheets

SMF OF MUSICAL PIECE B

SMF OF MUSICAL PIECE B

SMF OF MUSICAL PIECE B

SMF OF MUSICAL PIECE B

EDITING APPARATUS AND EDITING METHOD

BACKGROUND OF THE INVENTION

The present invention relates to an information outputting apparatus for generating and outputting information on musical pieces and/or musical performances stored typically in a standard MIDI (Musical Instrument Digital Interface) file, an information editing apparatus for carrying out necessary editing work on input information on musical pieces and/or musical performances and a recording medium for recording information on musical pieces and/or musical performances.

As a conventional standard of musical-performance data, the MIDI is very popular. With the conventional format, that is, a format of musical-piece/musical-performance data created by utilizing this MIDI information, a musical performance based on musical-performance data recorded and edited by a recording sequencer or recording sequence software for recording and editing the musical-performance data from MIDI information can not be performed by using a playback sequencer or playback sequence software for playing back the musical-performance data if the playback sequencer or playback sequence software is different from the recording sequencer or recording sequence software. In order to solve this problem, a standard MIDI file (referred to hereafter simply as an SMF (Standard MIDI File)) has been made popular.

In recent years, an SMF is used for storing musical-piece/musical-performance data transmitted to equipment such as a communication karaoke system. In a communication karaoke system, musical-piece/musical-performance data presented as an SMF is typically distributed to karaoke playback apparatuses each serving as a terminal by a server through public transmission lines such as telephone lines.

The karaoke playback apparatus is provided with a storage unit for storing typically the distributed musical-piece/musical-performance data and a sequencer and a sound source capable of playing back at least an SMF as musical-piece/musical-performance data. When the user makes a request for a musical piece or a musical performance by carrying out a predetermined operation, the karaoke playback apparatus reads out musical-piece/musical-performance data requested by the user from the storage unit to be played back by the sequencer to generate a MIDI event for driving the sound source. As a result, sound of the requested musical piece is generated for a karaoke.

However, the karaoke user of course has a desire to create an original karaoke typically composed of a medley by editing parts of musical pieces as the user likes within a range with a certain degree of freedom and to sing songs with the created karaoke used as a background.

In the data structure of an SMF, information on a point of time at which a certain MIDI message is generated is included as information on a relative time difference, that is, information on a time difference from typically immediately preceding event data. In consequence, when it is necessary to control a MIDI message generated in a real-time manner in an operation to play back an SMF, control of generation of sound by a MIDI apparatus at a point of time the MIDI message is generated relies on a MIDI message generated in the past. This reliance on a MIDI message generated in the past can be said to hold true of a case in which a MIDI message is generated to drive the sound source on the basis of an SMF. As a result, when editing work described above is carried out on an SMF, a problem described below arises.

Here, as an example, assume that editing work is carried out to create a medley comprising a first chorus of musical piece A and a second chorus of musical piece B concatenated each other to follow the first chorus as shown in FIG. 1. That is to say, pieces of SMF data each indicated by a shaded portion in the figure are linked to each other to form a medley to be reproduced in a playback operation.

A delimiter portion between the first and second choruses of musical piece B is shown in FIG. 2 by a score as musical sound actually generated. As shown in FIG. 2, the last musical sound of the first chorus is tones of a grand piano whereas the initial musical sound of the second chorus following the first chorus is tone of an acoustic guitar.

In the editing work, a position on SMF data in the first chorus of musical piece A and in the second chorus of musical piece B is set as an edit point.

In a MIDI format, a musical-performance part comprises a maximum of 16 channels. In an SMF format, musical-performance data of each channel can be collected in a track. FIG. 3 is a diagram showing a typical structure of musical piece B conforming to the SMF format.

It should be noted that, in order to make the explanation simple, FIG. 3 shows a configuration of musical piece B composed of two bars shown in FIG. 2. To put it in detail, the first chorus of musical piece B starts with the generated sound (a sound length of a dotted half-note) of note C from the first beat with tones of a grand piano whereas the second chorus of musical piece B starts with the generated sound (a sound length of a dotted half-note) of note C from the first beat with tones of an acoustic guitar.

As shown in FIG. 3, as an SMF format, a header chunk is provided at the beginning of a file of a musical piece. A header chunk is an area used for storing basic information on the file. The first 4 bytes of a header chunk are used for storing a chunk type. In the example shown in FIG. 3, the chunk type is represented by '4Dh, 54h, 68h, 64h' where the symbol h indicates a hexadecimal representation. The '4Dh, 54h, 68h, 64h' data represents a chunk type of 'MThd' by ASCII (American Standard Code for Information Interchange) characters. The chunk type is followed by 4 bytes representing a data length. The data length is the size of data following the chunk. In the present SMF format, the length of data following the header chunk has a fixed value of '00h, 00h, 00h, 06h' as shown in the figure.

After the data length, a format, the number of tracks and a unit time are each represented by 2 bytes. In the case of a contemporary SMF, 3 types of format are prescribed: format 0, format 1 and format 2. In the 2-byte format area following the data length as described above, one of the format types, namely, format 0, 1 or 2, is described. In the example shown in the FIG. 3, the 2 bytes have values of '00h, 00h' indicating that the type of the format of the file is format 0.

In the 2-byte area for the number of tracks, the number of track chunks following the header chunk is described. In the case of format 0, the file is prescribed by the format as a single-track file. Accordingly, in the example shown in FIG. 3, the number of tracks is prescribed as '00h, 01h'.

The unit-time area specifies the meaning of a delta time which is time information for each event, used in a data section of the track chunk. There are 2 types of time unit of an SMF, namely, a time unit with the location of a delimiter such as a bar or a pause mark on a score used as a reference and a time unit based on a time code of the absolute time. In the example shown in FIG. 3, the former time unit is used. In this case, a resolution per quarter note is indicated. A code of '01h, E0h' used in the example shows a resolution of 480 per quarter note. It should be noted that explanation of the time unit based on a time code of the absolute time is omitted.

A track chunk follows the header chunk described above. A track chunk starts with a 4-byte chunk type followed by a 4-byte area for describing a data length and ends with a data section.

In the example, the 4 bytes of the chunk type of the track chunk have values of '4Dh, 54h, 72h, 6Bh', ASCII characters representing a chunk type of 'MTrk'. The data section of a track chunk has a variable length depending on the contents of data. The length of the data section is described in a data-length area. In the example shown in FIG. 3, the data length is stored as '00h, 00h, 00h, 1Fh' indicating that the data section is 29 bytes long.

Each piece of event information stored in the data section is called an MTrk event. In an SMF, there are 3 types of events that can be stored as an MTrk event, namely, a MIDI event, a SysEx (System Exclusive) event and a meta event.

A MIDI event is an event for storing a MIDI channel message. A MIDI event serves as a substance of musical-performance data. The contents of a MIDI event of an SMF are a sequence of a MIDI message conforming to the MIDI format.

A SysEx event is an event mainly for storing a system-exclusive message in MIDI specifications. A meta event is an event for storing, for example, information related to the whole musical performance and necessary information used by a sequencer of sequence software. The contents of a meta event are not included in the musical-performance data itself.

An MTrk event is a MIDI, SysEx or meta event with a delta time (Δt) showing information on a time added thereto. That is to say, an MTrk event has one of the following formats:

[Delta time (Δt)] [MIDI event]

[Delta time (Δt)] [SysEx event]

[Delta time (Δt)] [Meta event]

A delta time is information on a time, that is, information on a relative time (time difference information) to an immediately preceding MITrk, which is expressed as a so-called variable-length number. The value of the delta time depends on a value specified as a unit time of the header chunk. In the case of a resolution of 480 per quarter note described above, for example, a delta time of 240 corresponds to an interval of an eighth note. An MTrk event coinciding with an immediately preceding MTrk event has a delta time of 0 added thereto.

It should be noted that a detailed explanation of rules of expressing the variable-length number prescribed in an SMF is omitted. The variable-length number is expressed as an array of minimum required bytes. In the SMF format, the delta time is represented by a minimum of 1 byte to a maximum of 4 bytes.

The data section of the example shown in FIG. 3 comprises a sequence of 7 MTrk events, namely, events 1 to 7.

MTrk event 1 is a MIDI event of a program-change message. The program-change message is represented by 'C0h, 00h'. The first byte of the program-change message is a status byte ('C0h'). The high-order 4 bits of the status byte is 'Ch' indicating status of the program-change message. The low-order 4 bits ('0h') of the status byte indicate the number of a channel to which the message is to be transmitted. A data byte of '00h' following the status byte is the number of the program.

MTrk event 1 having such values sets the tones of the grand piano for a channel specified by the low-order 4 bits ('0h') of the status byte as a sound source specified in conformity with specifications of typically a GM (general MIDI).

MTrk event 2 following MTrk event 1 is a MIDI event of a note-on message with the same timing as MTrk event 1 (delta time='00h'). MTrk event 2 specifies a note-on for the tones of the grand piano.

It should be noted that a status byte ('90h') at the head of the MIDI event of the note-on message indicates a note-on message for the tones of the grand piano. Much like MTrk event 1, the high-order 4 bits ('9h') of the status byte represents the status of the note-on whereas the low-order 4 bits ('0h') is the number of a message transmission channel. The first data byte ('3Ch') following the status byte is the number of a note to be generated and the second data byte ('40h') is a velocity. Here, as a note-off message, a note-on-message status of '00h' is used. A note-on velocity is a speed of playing a keyboard, that is, the volume of sound.

MTrk event 3 is a MIDI event of 'C0h, 18h' representing a program-change message. MTrk event 3 has a delta time of '83h, 60h' added thereto. This indicates that MIDI event specifies a switch with timing delayed by the delta time to an acoustic guitar as tones subjected to a note-on for a channel for which the tones of the grand piano is set earlier.

MTrk event 4 is a MIDI event of '90h, 3Ch, 00h' representing a note-on message. MTrk event 4 has a delta time of '87h, 40h' added thereto. This MIDI event specifies a note-off of the tones of the grand piano experiencing a note-on earlier. That is, the third byte of the note-on message normally represents a velocity, however, a code of '00h', set in the third byte as above allows the message to be interpreted as a note-on message.

MTrk event 5 is a MIDI event of '90h, 3Ch, 40h' representing a note-on message. MTrk event 5 has a delta time of '83h, 60h' added thereto. This MIDI event specifies a note-on for the tones of the acoustic guitar specified earlier by MTrk event 3.

MTrk event 6 is a MIDI event of '90h, 3Ch, 00h' representing a note-on message. MTrk event 6 has a delta time of '8Bh, 20h' added thereto. This MIDI event specifies a note-off for the tones of the acoustic guitar which has entered note-on earlier by MTrk event 5.

MTrk event 7 is a meta event indicating an end of track or an end of file. MTrk event 7 has a delta time of 'A1h, 60h' added thereto. This meta event indicates the end of the track chunk or, in the case of format 0, the end of the file. A meta event indicating the end of a track is prescribed to have a value of 'FFh, 2Fh, 00h' in the SMF format.

Assume that, in an SMF of musical piece B with a file structure shown in FIG. 3, a position between MTrk events 4 and 5 is set as an edit point shown in FIG. 2. This position is a data position corresponding to a break of sound at which the specification of a note-on and a note-off by the grand piano in the first chorus of musical piece B has been made.

Here assume that, by using the edit point shown in FIG. 3 as a base point, musical piece B is concatenated with musical piece A to follow musical piece A as described earlier by referring to FIG. 1. In this case, MTrk events after the edit point shown in FIG. 3 is concatenated with data at the end of the first chorus of musical piece A. To be more specific, the data section after MTrk event 5 shown in FIG. 3 is concatenated with a MTrk event corresponding to the end of the first chorus of musical piece A.

After the editing work, generation of sound by the acoustic guitar is required in the second chorus from which musical piece B starts. In the case of setting an edit point in MTrk event 5 as shown in FIG. 3, however, MTrk event 3 for storing a program-change message for switching the tones to the acoustic guitar is neglected so that MTrk event 3 does not exist any more at the data section after the editing work.

Assume that a musical performance is played back from an SMF file obtained as a result of the editing work described above. In this case, the tones of sound generated as a part of musical piece B is dependent on a program-change message set in preceding musical piece A with which musical piece B is concatenated. It is thus quite within the bounds of possibility that the tones of sound generated by the instrument initially as the part of musical piece B is not set correctly.

It is therefore quite within the bounds of possibility that a naturally desired musical-performance result can not be obtained due to the fact that some event information of data prior to the editing work is missing from data after the editing work. The missing data may occur on MIDI events other than a program-change message and event information of other types.

As is obvious from the explanation given so far, it is quite within the bounds of possibility that a desired musical-performance result can not be obtained from an SMF gained as a result of some editing work even if an edit point is set properly by considering only a position in an SMF corresponding to a break of sound and the editing work is done by using the edit point as a base point.

In order to solve the problem with regard to a musical performance played back from an SMF obtained as a result of data processing such as the editing work described above, a user who knows the MIDI format and/or the data structure of an SMF either generally uses a tool like editor software or a dedicated sequencer and/or sequence software to carry out the data processing.

Here, in the editing work using a sequencer and/or sequence software with a function of editing an SMF like the one described above, for example, in order to easily obtain coincidence of a delimiter position of data with a delimiter of played back sound obtained as a result of the editing work, it is normally necessary to carry out data preprocessing such as interpretation and development of the original data into a temporary data structure with an unique format different from that of the SMF. It should be noted, however, that such data preprocessing is by no means easy processing. In particular, if processing is required to be carried out concurrently with a playback operation in a real-time manner, the hardware and software must bear a pretty heavy load.

For example, consider the problem encountered in the SMF editing described above by focusing on editing work to create a medley which a user likes in a communication karaoke mentioned earlier. If a function for creating a medley by editing an SMF with simple operations carried out by the user itself is to be provided, the scales of the hardware and the software employed in the playback apparatus will become very large and the cost of the playback apparatus will increase accordingly.

SUMMARY OF THE INVENTION

It is an object of the present invention addressing the problems described above to provide a capability of edit processing executed by merely carrying out simple processing without the need to specially perform processing of converting the data structure of information on musical pieces and/or musical performances stored in an SMF or the like into another format.

In order to achieve the aforementioned object addressing the problems described above, the present invention provides an editing apparatus for editing information on musical performances by using an electronic musical instrument for carrying out a musical performance by mixing tones of a plurality of musical instruments on the basis of the information on musical performances including:

first event commands each consisting of an identifier showing a type of said musical instruments and a start address of a musical performance of said musical instrument described by said identifier; and a second event command indicating a start and an end of a musical performance of said musical instruments specified by said identifier in each of said first event commands, said editing apparatus comprising:

an edit-point setting means for setting an edit point at a position of a specific event command in said information on musical performances;

a judging means for forming a judgment as to whether or not the position of an edit point set by said edit-position setting means is described in said second event command; and an event-command adding means which is used for newly adding a first event command corresponding to one of said musical instruments to perform a musical performance after an edit point, if the position of said edit point is judged by said judging means to be described in said second event command.

DESCRIPTION OF THE PREFERRED EMBODIMENT

The present invention will become more apparent from a careful study of the following description of a preferred embodiment with reference to the accompanying diagrams. In the embodiment, an SMF for storing information on musical pieces and/or musical performances is used. It should be noted that the embodiment is described section after section in the following order:

1. Data Structure of the SMF
1-a. Edit-point denoting event
1-b. Edit-point control event
1-c. Structure of an SMF with inserted edit-point denoting events
2. Configuration of a Communication Karaoke System
3. Edit Processing 1. Data structure of the SMF 1-a. Edit-point denoting event In this embodiment, event information for showing an editable position in a sequence of an SMF, that is, an edit point, is specified. The event information is inserted into a position on the SMF sequence which is set as the edit point. First of all, the event information to be inserted into the edit point is explained. It should be noted that such event information is referred to hereafter as an edit-point denoting event.

The edit-point denoting event is defined as a meta event. As described before, a meta event is event information prescribed by an SMF format. Thus, while conforming to the SMF format, information showing an edit point can be inserted.

Figure 4:
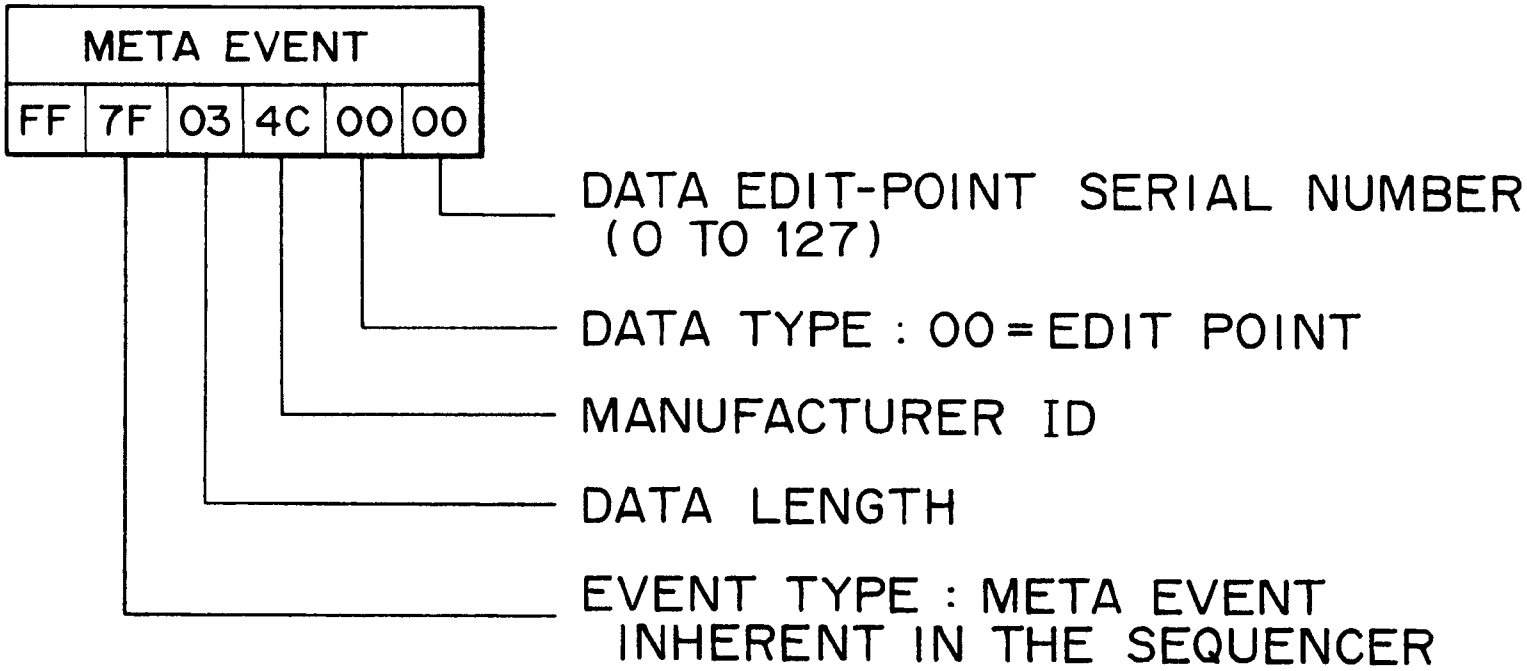
FIG. 4 is a diagram showing a data structure of an edit-point denoting event to be added at an edit point.

FIG. 4 is a diagram showing a data structure of an edit-point denoting event used in the embodiment. Since an edit-point denoting event is a meta event, the data structure of an edit-point denoting event conforms to the structure of a meta event prescribed by the SMF format.

The status byte at the head of a meta event is 'FFh' to indicate that the event is a meta event. In the following second byte, event-type information indicating the type of the event is stored. In the case of a meta event used as an edit-point denoting event, a value of '7Fh' is stored in this second byte as information on the type of an event. In this way, the information on the type of an event indicates that the edit-point denoting event is a meta event inherent in the sequencer. The following third byte specifies the data length of the meta event. In this case, a data length of '03h' indicates that there are 3 bytes following the data-length byte in the meta event.

In the case of an edit-point denoting event, in addition to the first 3 bytes of data described above, the fourth byte of the event indicates a manufacturer ID. The manufacturer ID indicates that this meta event is to be interpreted in the same way as a specific vendor, that is, in the vendor's own way. The manufacturer ID is an ID number unique to the vendor. That is to say, this meta event can be interpreted by a sequencer or sequence software made by a manufacturer indicated by the manufacturer ID. On the other hand, a sequencer or sequence software made by a manufacturer other than the manufacturer indicated by the manufacturer ID ignores this meta event. In the example shown in FIG. 4 the manufacturer ID is '4Ch'.

The following fifth byte indicates the type of the data. In this example, the type of the data '00h' is stored, indicating it as the event information which shows that this meta event is an edit-point denoting event.

The following sixth byte is data indicating a serial number of the edit point which has a value in the range 0 to 127, numbers expressed in the decimal representation. A serial number is a sequence number obtained by counting the number of edit-point denoting events inserted into a sequence of an SMF starting from the head of the sequence.

1-b. Edit-Point Control Event

Figure 5:
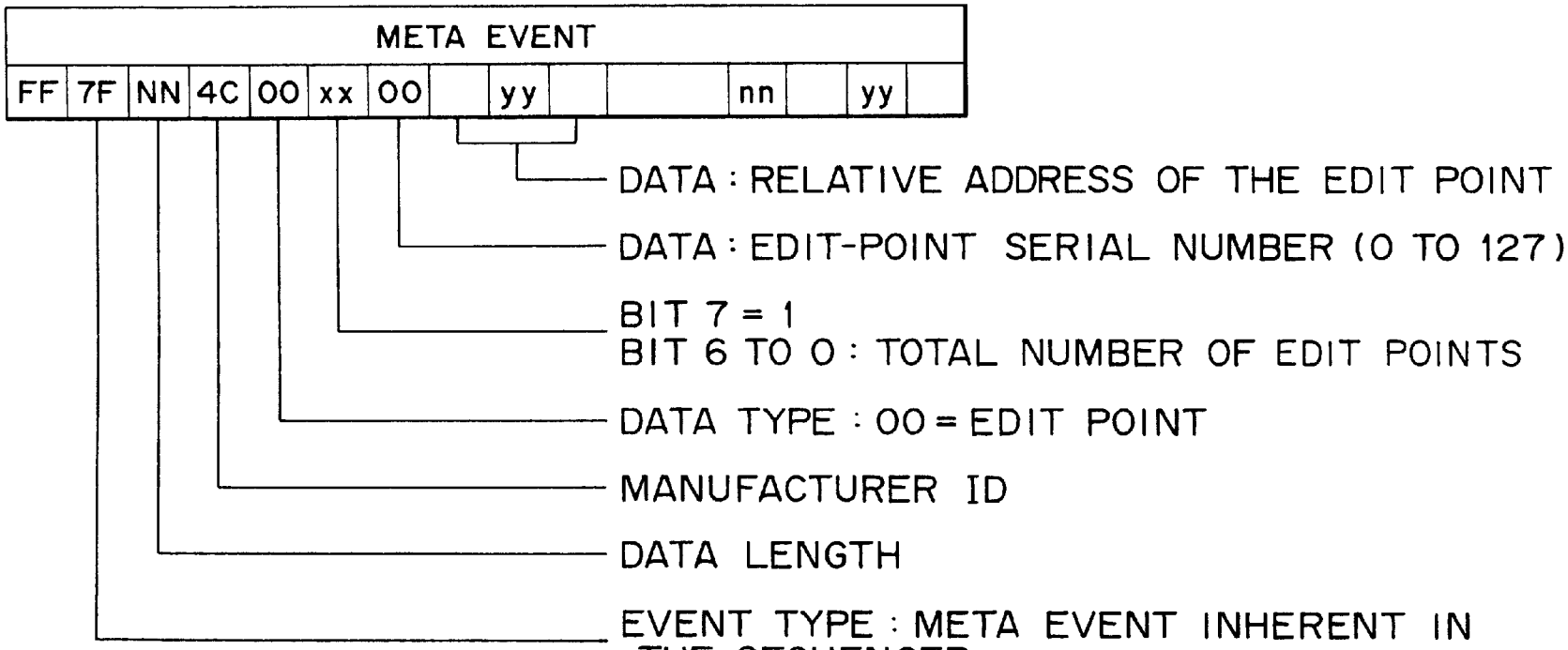
FIG. 5 is a diagram showing a data structure of an edit-point control event to be added at an edit point.

In this embodiment, an edit-point control event like the one shown in FIG. 5 is added at no later than a position preceding the first edit-point denoting event. The edit-point control event is also defined as a meta event. As will be described next, information indicating a position of each edit-point denoting event inserted into an SMF is stored in an edit-point control event. It is desirable to insert this edit-point control event into a position as close to the head of a file as possible. Typically, this edit-point control event may be inserted into a position immediately succeeding the head chunk.

Since the first to fifth bytes of an edit-point control event shown in FIG. 5 are defined in the same way as the counterpart bytes of the edit-control denoting event shown in FIG. 4, their explanation is omitted. Notation 'NN' placed in the third byte for storing the length of data indicates that the length of data varies in dependence on the number of edit-point denoting events actually inserted into the SMF. A value of '00h' is stored as a data type in the fifth byte to indicate that the data is edit-point denoting events, that is, to indicate that this edit-point control event is a meta event related to edit-point denoting events.

Bits 6 to 0 (that is, the descending 7 bits) of the sixth byte are the total number of edit points. That is to say, these bits indicate the number of all edit-point denoting events inserted into this SMF. A value of 1 put in bit 7 (bit 7=1) is an identification code for distinguishing the edit-point control event from an edit-point denoting event.

As described above, an edit-point control event and edit-point denoting events are inserted into an SMF. In an operation to search the SMF for an edit-point denoting event by referring to definitions of the meta event, the first meta event detected as an edit-point denoting event in the SMF sequence is taken as this edit-point control event. The edit-point control event can be distinguished from an edit-point denoting event by examining bit 7 of the sixth byte described above.

In the edit-point control event, after the seventh byte are data. The seventh byte is the serial number of an edit point and the eighth to tenth bytes are a relative address treated as a lump of data of the edit point. That is to say, the position on the SMF of an edit point indicated by a serial number stored in the seventh byte is specified by a 3-byte relative address stored in the eighth to tenth bytes following the seventh byte.

The relative address of an edit point is an address with typically a predetermined position on the edit-point control event taken as a reference. The relative address is expressed in a variable-length numerical expression. Thus, the relative address of an edit point has a variable size in the range from 1 to 4 bytes.

Bytes following the tenth byte are pieces of data each comprising a 1-byte serial number of an edit point which is incremented sequentially and a variable-size relative address composed of 1 to 4 bytes for storing a relative address showing the position of the edit point indicated by the 1-byte serial number. This pattern of this piece of data is repeated to form a sequence of pairs of an edit-point serial number and an edit-point relative address.

It should be noted that, if an edit-point denoting event shown in FIG. 4 is inserted into an SMF provided by the embodiment, the position of an edit point on the SMF can be identified from the edit-point denoting event. Thus, the edit-point control event shown in FIG. 5 is not absolutely required. If an edit-point control event is inserted into a position close to the head of a file as described above, however, the number of edit-point denoting events inserted thereafter and the positions of the edit-point denoting events can be identified quickly by reading out the contents of the edit-point control event.

1-c. Structure of an SMF with inserted edit-point denoting events

Figure 1:
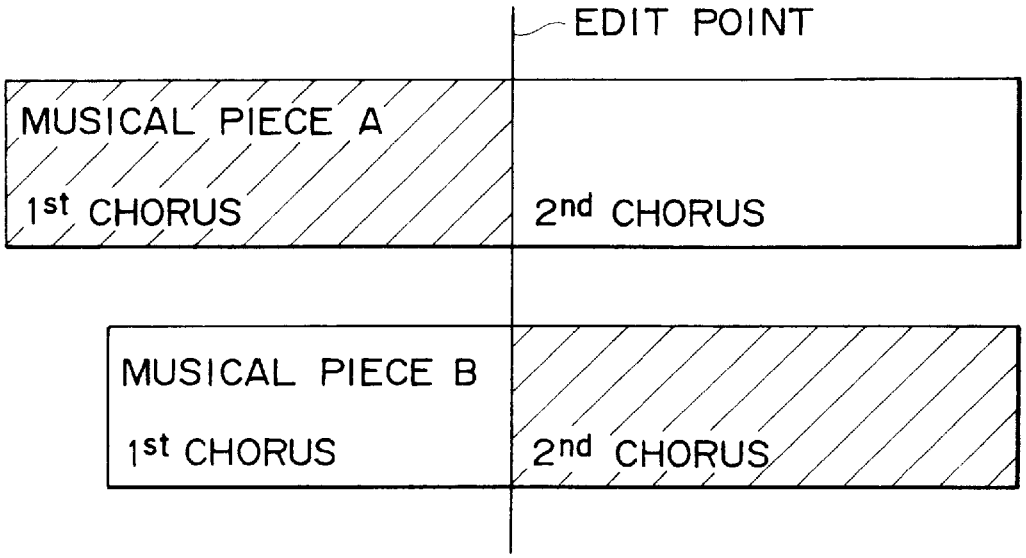
FIG. 1 is an explanatory schematic sketch used for describing a state of editing to concatenate 2 musical pieces with each other in accordance with the present invention.
Figure 6:
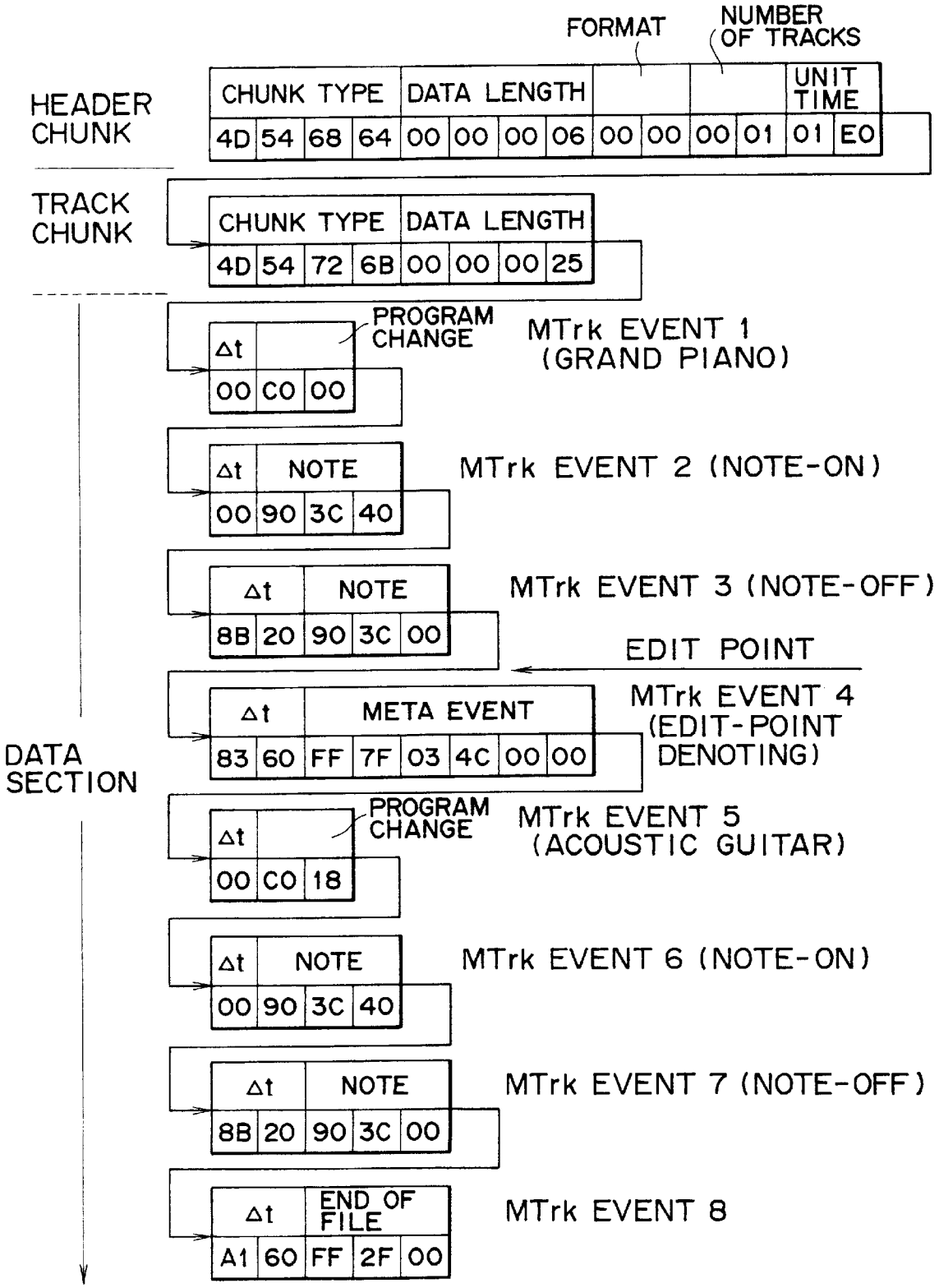
FIG. 6 is a diagram showing standard MIDI file data of a musical piece to be edited in accordance with the present invention.

Next, a typical data structure of an SMF having edit-point denoting events inserted thereinto is explained by referring to FIG. 6. FIG. 6 is a diagram showing a data structure of an SMF of musical piece B shown in FIGS. 1 and 2 with edit-point denoting events inserted thereinto.

Figure 3:
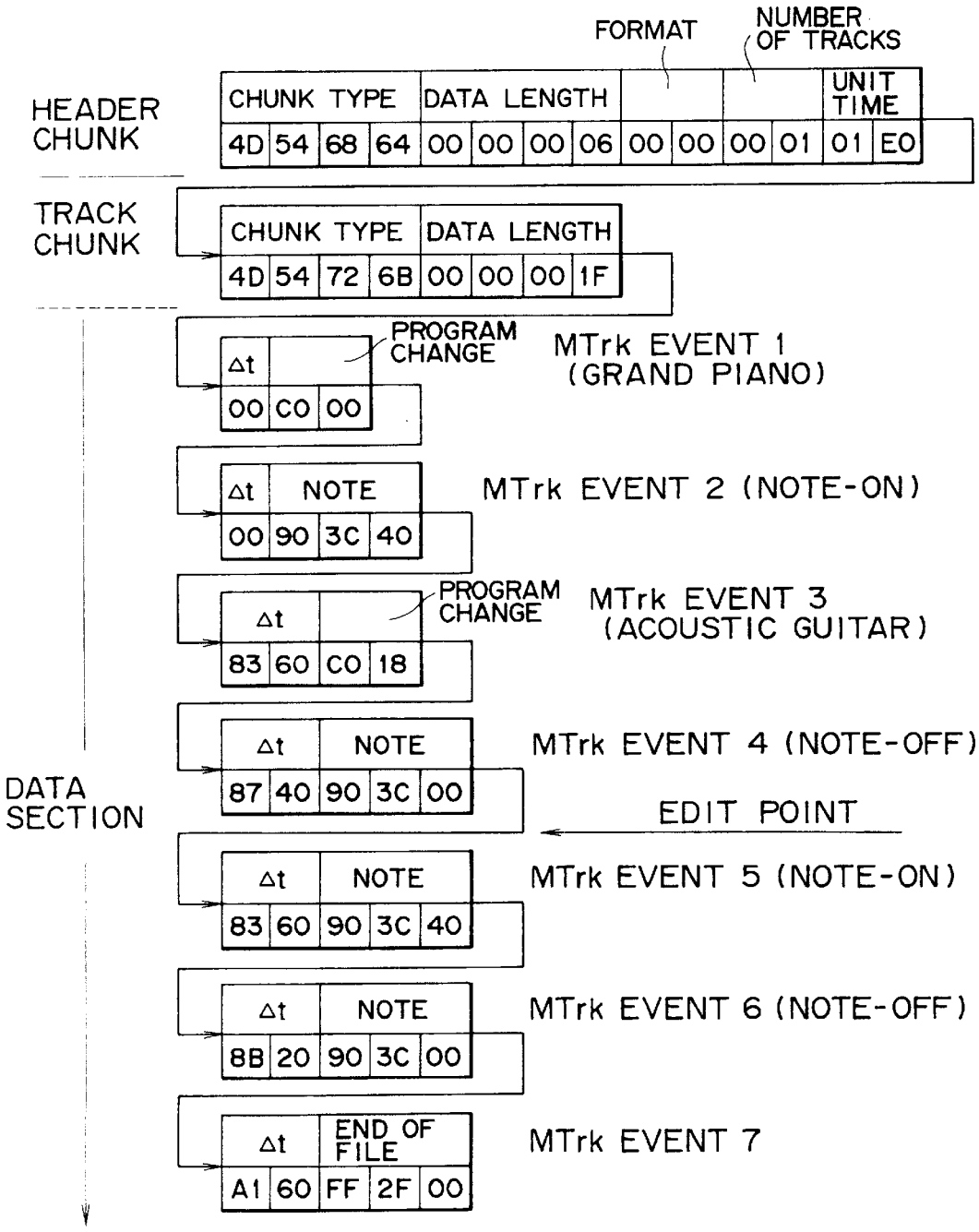
FIG. 3 is a diagram showing standard MIDI file data of a musical piece to be edited in accordance with the conventional method.

It should be noted that explanation of portions of the data structure of FIG. 6 represented by the same notations indicating the same definitions and contents as those of the SMF of musical piece B shown in FIG. 3 is not repeated.

Figure 2:
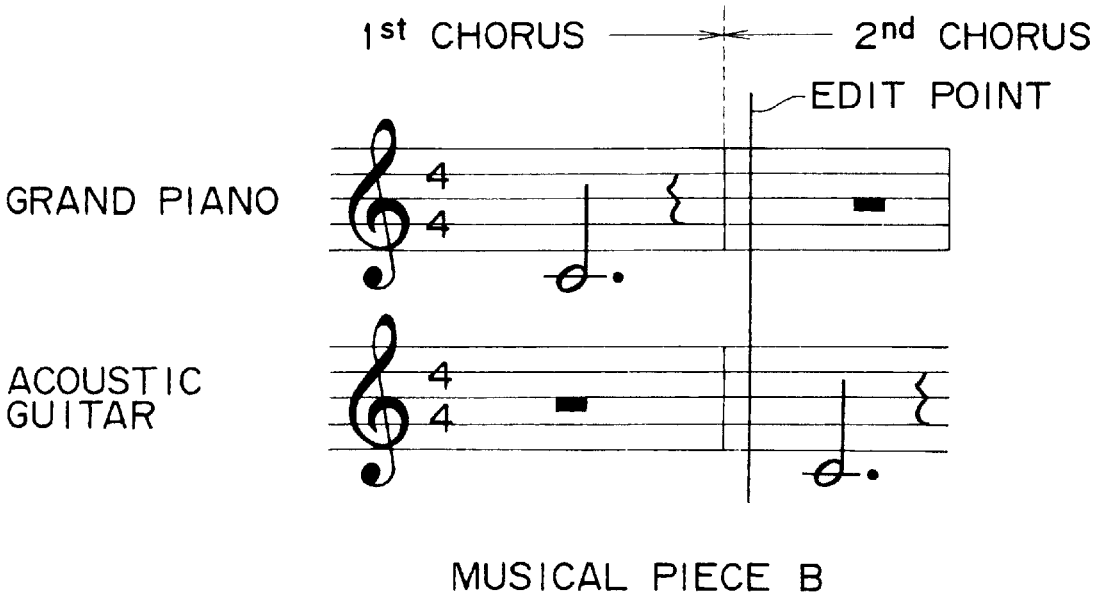
FIG. 2 is a diagram showing scores of musical pieces to be edited shown in FIG. 1 in accordance with the present invention.

In the data section of the SMF of musical piece B shown in FIG. 6, event information for performing a musical performance of the first chorus shown in the score of FIG. 2 is stored in the first MTrk events, namely, MTrk events 1 to 3, which are laid out continuously in sequence. A program change stored in MTrk event 1 is a MIDI event specifying the tones of the grand piano. A MIDI event of MTrk event 2 following MTrk event 1 specifies a note-on message for the tones of the grand piano. MTrk event 3 specifies a note-off message for the tones of the grand piano.

Event information for performing a musical performance of the second chorus shown in the score of FIG. 2 is stored in the subsequent events, namely, MTrk events 5 to 7, which are laid out continuously in sequence. A program change stored in MTrk event 5 is a MIDI event specifying the tones of the acoustic guitar. A MIDI event of MTrk event 6 following MTrk event 5 specifies a note-on message for the tones of the acoustic guitar. MTrk event 7 specifies a note-off message for the tones of the acoustic guitar.

MTrk event 4 inserted between MTrk events 1 to 3 for storing information on a musical performance of the first chorus and MTrk events 5 to 7 for storing information on a musical performance of the second chorus serves as an inserted edit-point denoting event. That is to say, an edit point is set between MTrk event 3 and MTrk event 5.

In this case, a delta time of '83h, 60h' is appended to MTrk event 4 used as an inserted edit-point denoting event. The serial number of the edit point in the sixth byte of the edit-point denoting event is set at a value of 00h which indicates that MTrk event 4 is the first edit-point denoting event inserted into the sequence of the SMF of musical piece B shown in FIG. 3.

It should be noted that the edit-point control event explained earlier by referring to FIG. 5 is not inserted in this instance. If it is desired to insert an edit-point control event for example into the file shown in FIG. 5, it may be possible to insert the edit-point control event into a position relatively close to the head of the data such as a position immediately succeeding the header chunk as described before.

As described above, in this embodiment, a plurality of pieces of control information (or event information) for a certain sound are laid out on an SMF at such positions that pieces of such information for a chorus is not split by an edit point.

To be more specific, in the case of the example shown in FIG. 6, pieces of control information are laid out at such positions that MTrk events 1 to 3 for storing musical-performance information for the first chorus are collected as a lump not split by an edit point whereas MTrk events 5 to 7 for storing musical-performance information for the second chorus are collected as another lump also not split by an edit point. Then, at a position on the SMF corresponding to a break of sound, an edit point is set and an edit-point denoting event is inserted into this position. In the example shown in FIG. 6, the edit-point denoting event is inserted as MTrk event 4.

It should be noted that, actually, other events such as SysEx events and meta events of types other than an edit-point denoting event can be properly laid out at positions before and after an edit point in place of such MIDI events so as to reflect appropriate results of a musical performance that will be obtained from the editing work.

By having such a data structure, when an SMF is to be edited at the playback apparatus for example, an edit point can be found by searching the SMF for an edit-point denoting event associated with the edit point. With identified edit points used as base points, necessary edit processing is carried out by extracting required data segments on the SMF. As an alternative, if an edit-point control event exists, positions of edit-point denoting events following the edit-point control event can be identified by referring to the contents of the edit-point control event. In this case, required pieces of event information such as mainly MIDI events are laid out as data at positions before and after an edit point as shown in FIG. 3. Thus, in data segments of the SMF extracted for edit-processing purposes, event information for realizing an originally demanded musical-performance result is entirely provided. That is to say, as a new SMF is created as a result of editing work, a proper playback result (musical-performance state) is obtained.

To put it concretely, when edit processing described by referring to FIG. 2 is carried out on the SMF of musical piece B shown in FIG. 6, as a part of the second chorus of musical piece B following a part of the first chorus of musical piece A, data following the edit point shown in FIG. 6 is concatenated.

As data following the edit point shown in FIG. 6, all MTrk events 5 to 7 are provided without losing any of the event information required for generating sound by the tones of the acoustic guitar as typically shown in FIG. 3. As a result, when the SMF obtained as a result of the editing work is played back, at the beginning of the musical performance of musical piece B following the part of musical piece A, sound of necessary notes of the acoustic guitar is generated properly.

Figure 12:
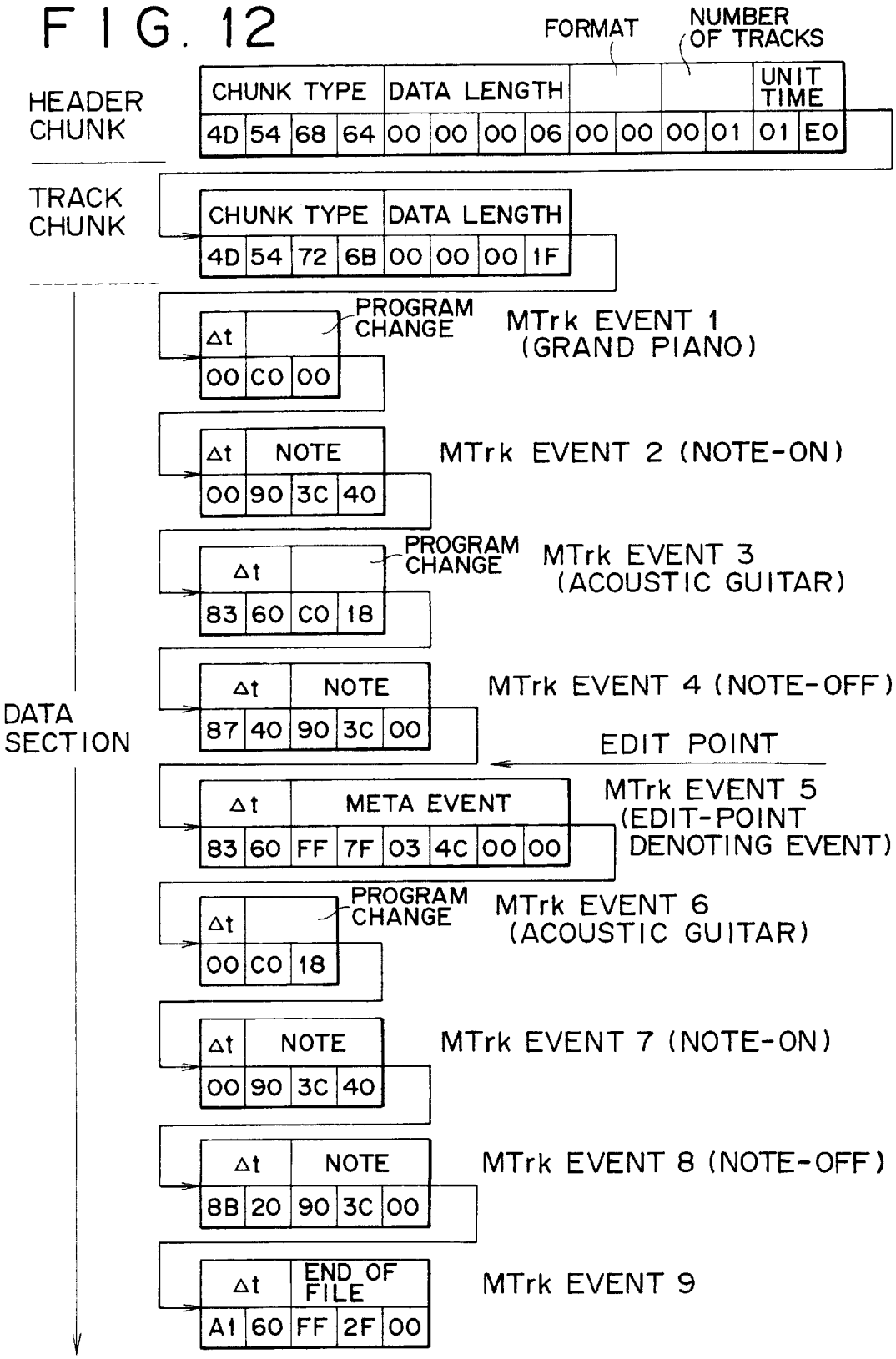
FIG. 12 is a diagram showing standard MIDI file data of musical pieces to be edited in accordance with the present invention.

In addition, in the present invention, an SMF file can be searched for MTrk event 3, which is a program-change event describing the type of a musical instrument before the edit point, and the program-change event can be set again as MTrk event 6 with the edit point used as a start point as shown in FIG. 12. In this case, the delta time of MTrk event 6 is set at '00', since a delta time has been set for MTrk event 5. In this way, an edit point can be set arbitrarily.

Of course, if a standard MIDI file to be edited is described as a continuous sequence of sets of 3 event commands, namely, a program-change event, a note-on event and a note-off event, for a plurality of musical instruments, it is not necessary to search the SMF sequence for a program-change event representing the type of a musical instrument existing at a position immediately preceding an edit point located just in front of a program-change event.

2. Configuration of the Communication Karaoke System

Figure 7:
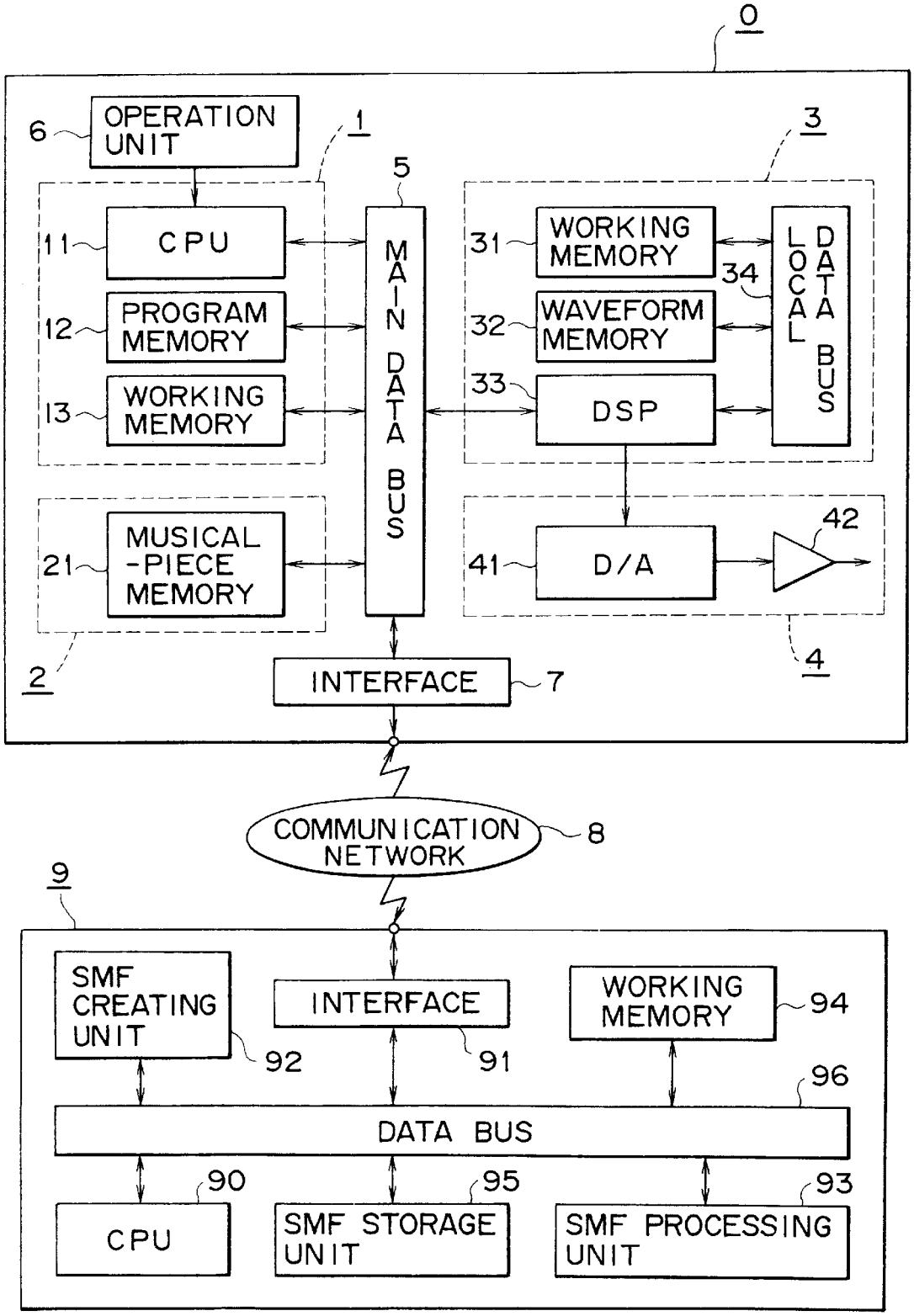
FIG. 7 is a block diagram showing transmitting and receiving systems to/from which a standard MIDI file is transmitted/received in accordance with the present invention.

The configuration of a communication karaoke system implemented by the embodiment is explained by referring to FIG. 7. The communication karaoke system is a system provided with a transmission apparatus 9 and a playback apparatus 0. In the figure showing the communication karaoke system, reference numerals 0 and 9 denote the playback and transmission apparatuses respectively. The transmission apparatus 9 is explained first as follows.

The transmission apparatus 9 is capable of communicating with a plurality of playback apparatuses 0 installed at karaoke entertainment sites and homes through a communication line (or communication network) 8 such as a telephone line.

The transmission apparatus 9 comprises a CPU 90, an interface unit 91, an SMF creating unit 92, an SMF processing unit 93, a working memory 94 and an SMF storage unit 95 and each of them are connected through data bus 96.

The CPU 90 is typically implemented by a microcomputer for controlling the other functional circuit components of the transmission apparatus 9. The interface unit 91 implements communication with the playback apparatuses 0 through the communication network 8 according to a predetermined transmission protocol.

The SMF creating unit 92 carries out processing to create an SMF containing karaoke musical-piece data by recording and editing actually input MIDI messages.

The SMF processing unit 93 carries out processing on an SMF with no edit points set therein like the one shown in FIG. 2 to create an SMF with edit points set therein like the one shown in FIG. 6. The working memory 94 is used as a working area typically for executing processing by the SMF processing unit 93 to create an SMF with edit points set therein.

The SMF storage unit 95 is implemented by a recording medium of a predetermined type having a relatively large storage capacity. The SMF storage unit 95 is used for storing mainly a large number of SMFs to be transmitted by the transmission apparatus 9 to the playback apparatuses 0. Assume for example that a signal requesting transmission of karaoke data of a musical piece is transmitted by one of the playback apparatuses 0 to the transmission apparatus 9 by way of the communication network 8. In this case, the CPU 90 receives the signal of request information, and then searches the SMF storage unit 95 for SMF data of a musical piece requested by the signal. The SMF data is then transmitted by the interface unit 91 to the playback apparatus 0 making the request of transmission by way of the communication network 8.

Figure 8:
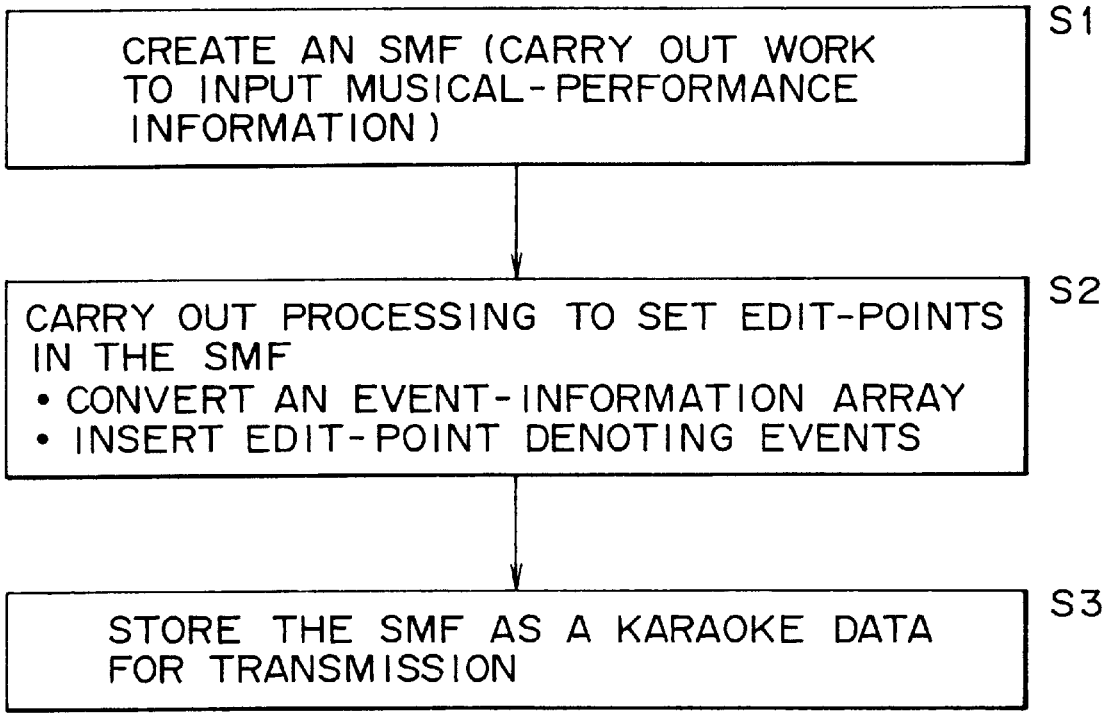
FIG. 8 shows a flowchart representing a procedure for creating a standard MIDI file at the transmitting end.

A typical process of creating an SMF by the transmission apparatus 9 in accordance with the present invention is represented by a flowchart shown in FIG. 8. As shown in the figure, the process begins with a step S1 at which work to create an SMF of typically a musical piece is done. This work is done typically by using equipment such as a sequencer or a musical instrument serving as a MIDI input apparatus. In this work, the musical performer supplies MIDI information to the SMF creating unit 92 while actually performing a musical performance and the SMF creating unit 92 carries out processing such as necessary editing work on the MIDI information.

At a stage in which SMF data has been created through the work to create an SMF done by the SMF creating unit 92 as described above, it is determined that no edit point shown in FIG. 3 has been inserted into the SMF data as is the case with ordinary SMF data shown in FIG. 2. The flow of the process then goes on to a step S2 at which data processing is carried out to set edit points in the SMF data created by the SMF creating unit 92 at the step S1. In this data processing, typically, edit-point denoting events are inserted into edit points, for example, chorus delimiters and climax portions of a song set in the SMF data of a musical piece in advance by the vendor and, if necessary, pieces of necessary event information such as mainly MIDI events are sorted so as to produce a desired musical-performance result of a data segment delimited by the edit-point denoting events. It is needless to say that, at that time, processing to change delta times appended to the event information of the SMF prior to the conversion may be carried out if deemed necessary.

The flow of the process then proceeds to a step S3 at which the SMF with edit points set therein at the step S2 is stored in the SMF storage unit 95 as communication karaoke data.

It should be noted that, as the transmission apparatus 9 provided by the embodiment, functional circuits having the SMF creating unit 92, the SMF processing unit 93 and the working memory 94 or the like used for creating an SMF and setting edit points in the SMF can be externally provided as components external to the transmission apparatus 9. That is to say, edit points can be set in an SMF by external equipment such as a sequencer having a function for setting edit points and the SMF is supplied from the external equipment to the SMF storage unit 95 to be stored therein.

Next, the playback apparatus 0 is explained. As shown in FIG. 7, the playback apparatus 0 comprises a system control unit 1, a data storage unit 2, an audio-signal processing unit 3, an audio output unit 4, an interface unit 7 and a main data bus 5 connecting the functional circuit components to each other.

The interface unit 7 is provided for carrying communication with the transmission apparatus 9.

The system control unit 1 comprises a CPU (Central Processing Unit) 11, a program memory 12 and a working memory 13. The system control unit 1 serves as a functional circuit member for generating MIDI messages for an operation to play back a musical piece by mainly reading out an SMF stored in a musical-piece memory 21 of the data storage unit 2 to be described later. In addition, the system control unit 1 also carries out edit processing to create an SMF for playing back a medley in an operation to play back a medley to be described later. The edit processing is based on edit points set in the SMF.

The CPU 11 is implemented typically by a microcomputer for carrying out necessary processing to control general operations of the playback apparatus 0. The control processing includes the processing to generate a MIDI message and the edit processing described above. In addition, the CPU 11 also carries out processing to generate a signal to request the transmission apparatus 9 to transmit a desired musical piece.

Typically implemented by a ROM, the program memory 12 is used for storing, among other information, a program to be executed by the CPU 11 to carry out the necessary control processing. Typically implemented by a RAM, on the other hand, the working memory 13 serves as a working area used for temporarily storing various kinds of processing data and a variety of processing results during execution of the necessary control processing by the CPU 11. Particularly, in this embodiment, the working memory 13 is used during editing work or the like for an operation to play back a medley to be described later.

The data storage unit 2 includes a musical-piece memory 21 used for storing a lot of SMF supplied thereto by the transmission apparatus 9 of the musical-piece vendor by way of the communication network 8.

The type of a recording medium used as the musical-piece memory 21 for storing SMFs is not specified in particular. Any type can be used as long as the recording medium provides sufficient storage capacity large enough for storing as many SMFs as desired musical pieces at the same time in its practical use. Examples of recording media that can be used as the musical-piece memory 21 are a variety of disc recording media including mainly memory devices and hard discs with a large storage capacity. If the recording medium used as the musical-piece memory 21 is detachable, a library for storing SMFs used in the embodiment can be created on the recording medium. In addition, the means for storing an SMF in the musical-piece memory 21 is not limited to the means for supplying an SMF from the transmission apparatus 9 to the playback apparatus 0 via the communication network 8 as described above. For example, SMF data stored in an external storage device can also be supplied to the playback apparatus 0 through equipment such as a data interface not shown in the figure.

The operation unit 6 is provided with a set of keys necessary for carrying out, among other things, a variety of playback operations based on an SMF and an operation to play back a medley to be described later in the playback apparatus 0. Information on an operation generated as a result of the operation carried out by the user on the operation unit 6 is supplied to the CPU 11, which then carries out necessary processing in accordance with the information input thereto.

For example, assume that the user operates the operation unit 6 to enter information on an operation for normally playing back the SMF of a musical piece. In this case, the CPU 11 searches the musical-piece memory 21 for an SMF selected by the user through the operation carried out on the operation unit 6. The SMF is then read out from the musical-piece memory 21 and a MIDI message is created in accordance with the contents of the SMF. Subsequently, the MIDI message is transferred to the audio-signal processing unit 3 by way of the main data bus 5.

Composed of a working memory 31, a waveform memory 32, a DSP (Digital Signal Processor) 33 and a local data bus 34 for transmitting data among these components, the audio-signal processing unit 3 serves as a circuit member for controlling actual generation of sound of a musical piece according to a MIDI message generated by the system control unit 1.

The waveform memory 32 is used for storing basic waveform data of a variety of tones. A predetermined tone is assigned to a program number at least in accordance with typical GM (General MIDI) specifications.

The DSP 33 carries out necessary signal processing on waveform data of a tone selected from those stored in the waveform memory 32 in accordance with a MIDI message received from the system control unit 1 in order to generate audio data as a musical piece. The audio data is supplied to the audio output unit 4. The working memory 31 is used as a working area in audio-signal processing carried out by the DSP 33 on waveform data of a tone.

In the audio output unit 4, audio data supplied thereto by the DSP 33 is converted by a D/A converter 41 into an analog audio signal which is then output by way of an amplifier 42. As a result, an audio signal played back on the basis of an SMF is output.

3. Edit Processing

In the playback apparatus 0 with the configuration described above, it is possible to carry out edit processing for playing back a medley by using an SMF with inserted edit-point denoting events and an inserted edit-point control event.

In this case, parts of musical pieces (SMFs) to be used in an operation to play back a medley and an order of concatenation of the parts are specified by the user by carrying out predetermined operations on the operation unit 6. The playback apparatus 0 plays back the medley by reproducing the parts of the specified musical pieces (SMFs) in accordance with the specified order of concatenation.

To play back a medley, the user carries out operations specifying the medley on the operation unit 6 in accordance with procedures 1 to 4 as follows:

Procedure 1: Specify a musical piece (SMF) to be used in the operation to play back a medley.

Procedure 2: Specify a part in the musical piece specified in procedure 1 to be used in the operation to play back the medley.

In this embodiment, a data segment in an SMF delimited by 2 consecutive edit-point denoting events is called a "part". Each part has a part number which is obtained as a result of counting the number of parts from the beginning of the file. The value of the part number is equal to (a+1) where the symbol "a" is the serial number of an edit point recorded in the edit-point denoting event corresponding to the part. To be more specific, a part number of 0 is assigned to a first part at the head of the file including no edit-point denoting event and a part number of 1 is assigned to the following part. The serial number of an edit point recorded in an edit-point denoting event corresponding to this second part is '00h', Part numbers of 2, 3, 4 to n are assigned to the subsequent parts.

Procedure 3: Repeat the operations of procedures 1 and 2 according to a procedure to play back a medley. It should be noted that, when the operation of procedure 3 is completed, it is necessary to carry out an operation indicating the completion of the operations required to play back a medley.

Procedure 4: Carry out an operation to start processing to play back the medley.

Figure 9A:
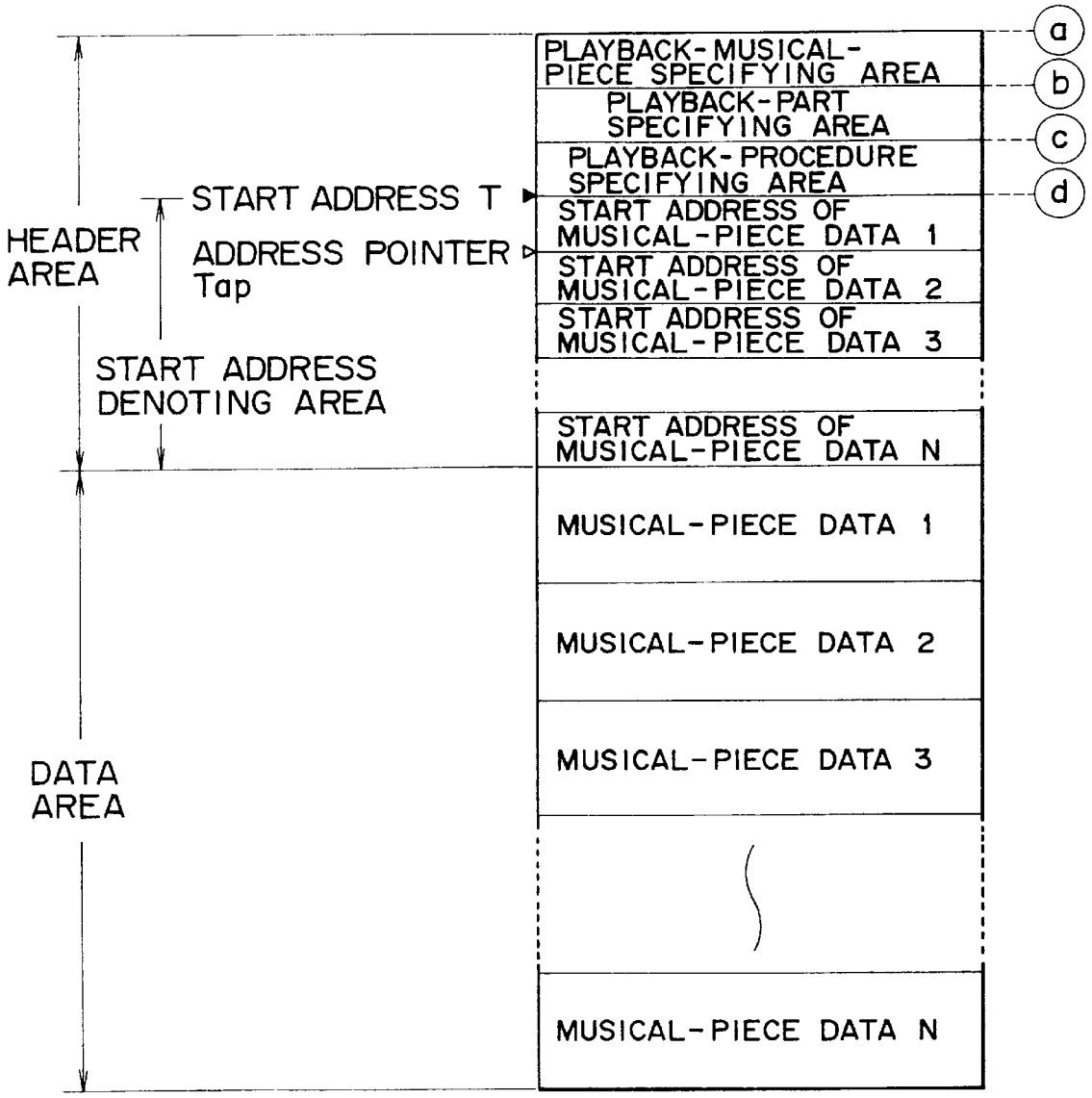
FIG. 9A is a diagram showing a data structure of a memory comprising a header area for storing control data and a data area for storing MIDI data.
Figure 9:
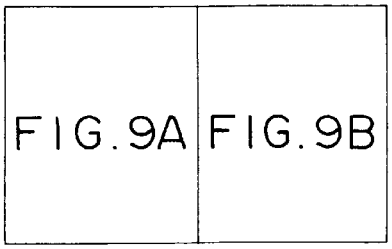
FIG. 9 including
Figure 9B:
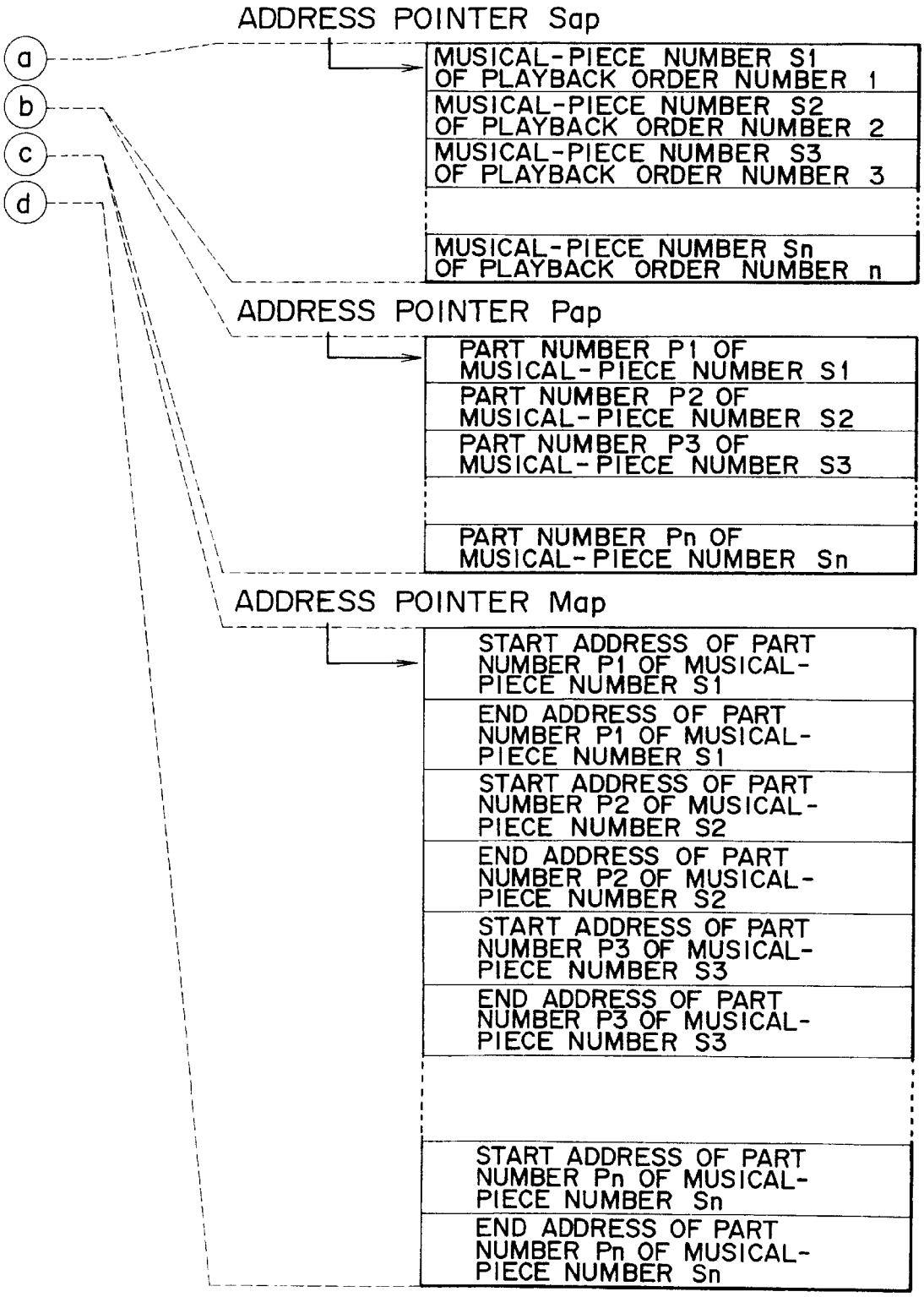
FIG. 9B is a diagram showing a data structure of the control data stored in the header area.

FIGS. 9A and 9B are diagrams each showing a typical data mapping layout of the musical-piece memory 21.

The data area of the musical-piece memory 21 is divided into a header area and a data area. First of all, the data area is explained. In the data area, a number of musical pieces of SMF data, namely, musical-piece data 1 to N are stored. Used as musical-piece numbers, the numbers 1 to N are such an ascending order, in which the pieces of SMF data are stored in the musical-piece memory 21.

On the other hand, the header area comprises a playback-musical-piece specifying area, a playback-part specifying area, a playback-procedure specifying area and a start-address specifying area. In the start-address specifying area, start addresses value of pieces of musical-piece data 1 to N stored in the data area are stored sequentially in the order, in which the pieces of musical-piece data 1 to N are stored in the data area. In the playback-musical-piece specifying area, the playback-part specifying area and the playback-procedure specifying area, proper data is stored in accordance with operations to specify processing to play back a medley carried out in procedures 1 to 3 described above. The data is used in a way to be described later.

Figure 10:
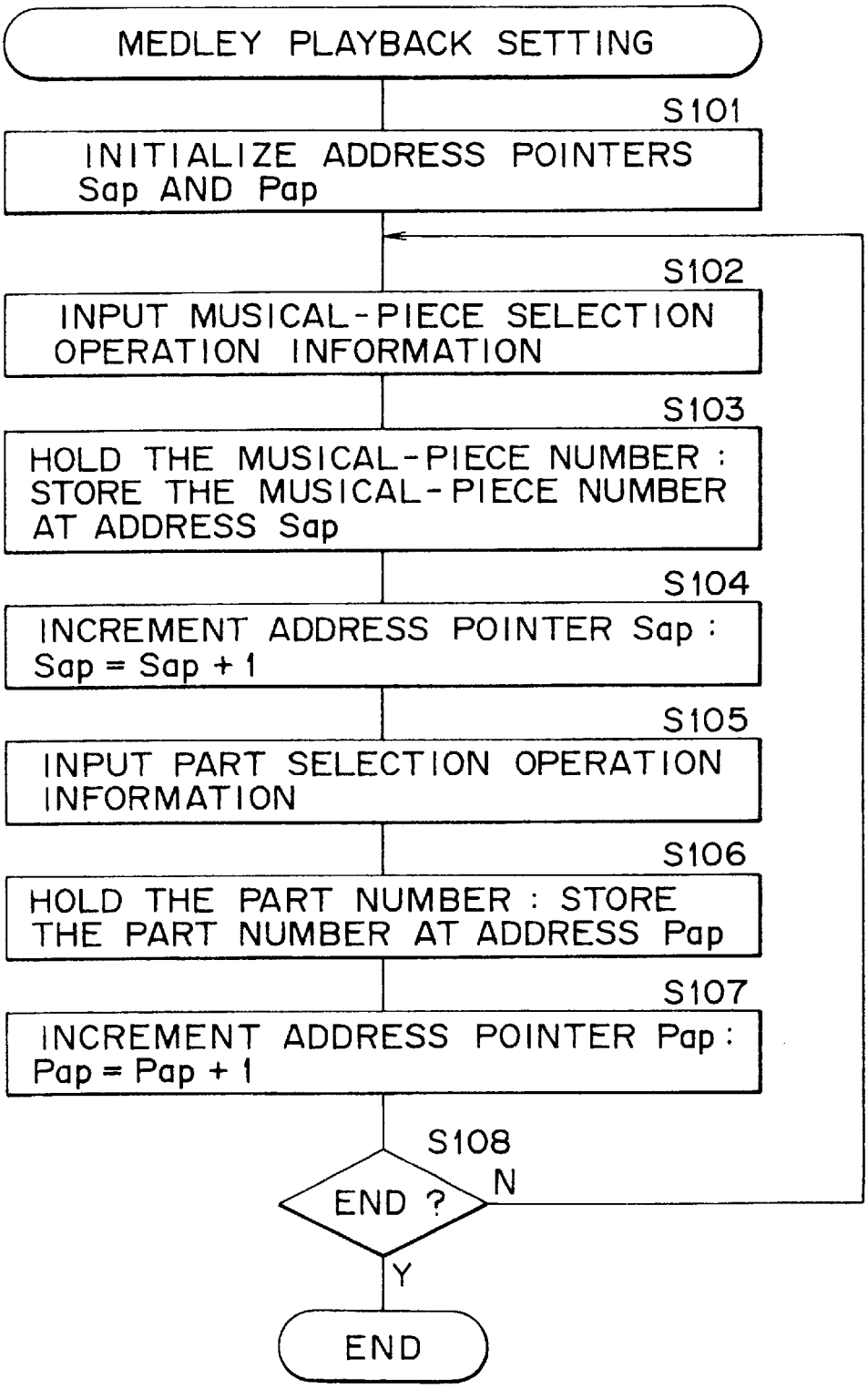
FIG. 10 shows a flowchart representing a setting procedure for playback-musical-pieces and playback-parts required in an operation to play back a medley in accordance with the present invention.

FIG. 10 shows a flowchart representing a procedure of processing carried out by the CPU 11 in response to operations carried out by the user for specifying playback parts and specifying playback musical pieces required in processing to play back a medley.

As shown in the figure, the processing begins with a step S101 at which address pointers Sap and Pap are initialized. The address pointer Sap points to the playback-musical-piece specifying area and the address pointer Pap points to the playback-part specifying area as shown in FIG. 9B. The address pointers Sap and Pap are initialized to set the value corresponding to start addresses of the playback-musical-piece specifying area and the playback-part specifying area respectively therein.

The flow of the processing then goes on to a step S102 at which operation information for playing back musical pieces specified by the operation of procedure 1 is input. Then, the flow of the processing proceeds to a step S103 at which processing is carried out to hold a musical-piece number included in musical-piece data input at the step S102. To put it in detail, the musical-piece number included in the musical-piece data is stored at an address in the playback-musical-piece specifying area specified by the current value of the address pointer Sap. For example, in the operation of procedure 1 corresponding to the step S102, the user initially specifies a first musical piece at the top of a playback order. In this case, at the step S103, a musical-piece number S1 of the first musical piece in the playback order included in the musical-piece data specified by procedure 1 is stored on the top line of the playback-musical-piece specifying area as shown in FIG. 9B. When the processing at the step S103 is completed, the flow continues to a step S104 at which the CPU 11 increments the value of the address pointer Sap before going on to a step S105.

At the step S105, specification of a part entered by the user through the operation of procedure 2 is input. Then, the flow of processing proceeds to a step S106 at which processing is carried out to hold a part number included in the part specifying information input at the step S105. To put it in detail, the part number included in part data is stored at an address in the playback-part specifying area specified by the current value of the address pointer Pap. For example, in the operation of procedure 2, if the user specifies a part of the first musical piece, at the step S106, a part number P1 of the specified part included in a musical piece identified by the musical-piece number S1 as specified by procedure 2 is stored on the top line of the playback-part specifying area as shown in FIG. 9B.

When the processing at the step S106 is completed, the flow continues to a step S107 at which the CPU 11 increments the value of the address pointer Pap before going on to a step S108.

At the step S108, the CPU 11 forms a judgment as to whether or not an operation to indicate the end of the operation of procedure 3, an iteration of procedures 1 and 2, has been carried out. If an operation to indicate the end of the operation of procedure 3 has not been carried out, the flow of the processing goes back to the step S102.

Thus, the series of processing of the steps S102 to S108 are carried out repeatedly until the outcome of the judgment formed at the step S108 indicates that an operation to indicate the end of the operation of procedure 3 has been completed. As a result, musical-piece numbers and part numbers are stored sequentially in the playback-musical-piece specifying area and the playback-part specifying area respectively.

The processing to set a medley shown in FIG. 10 is completed when the outcome of the judgment formed at the step S108 indicates that an operation to indicate the end of the operation of procedure 3 has been carried out. At this stage, musical-piece numbers and part numbers have been stored sequentially in the playback-musical-piece specifying area and the playback-part specifying area respectively as shown in FIG. 9B.

Figure 11A:
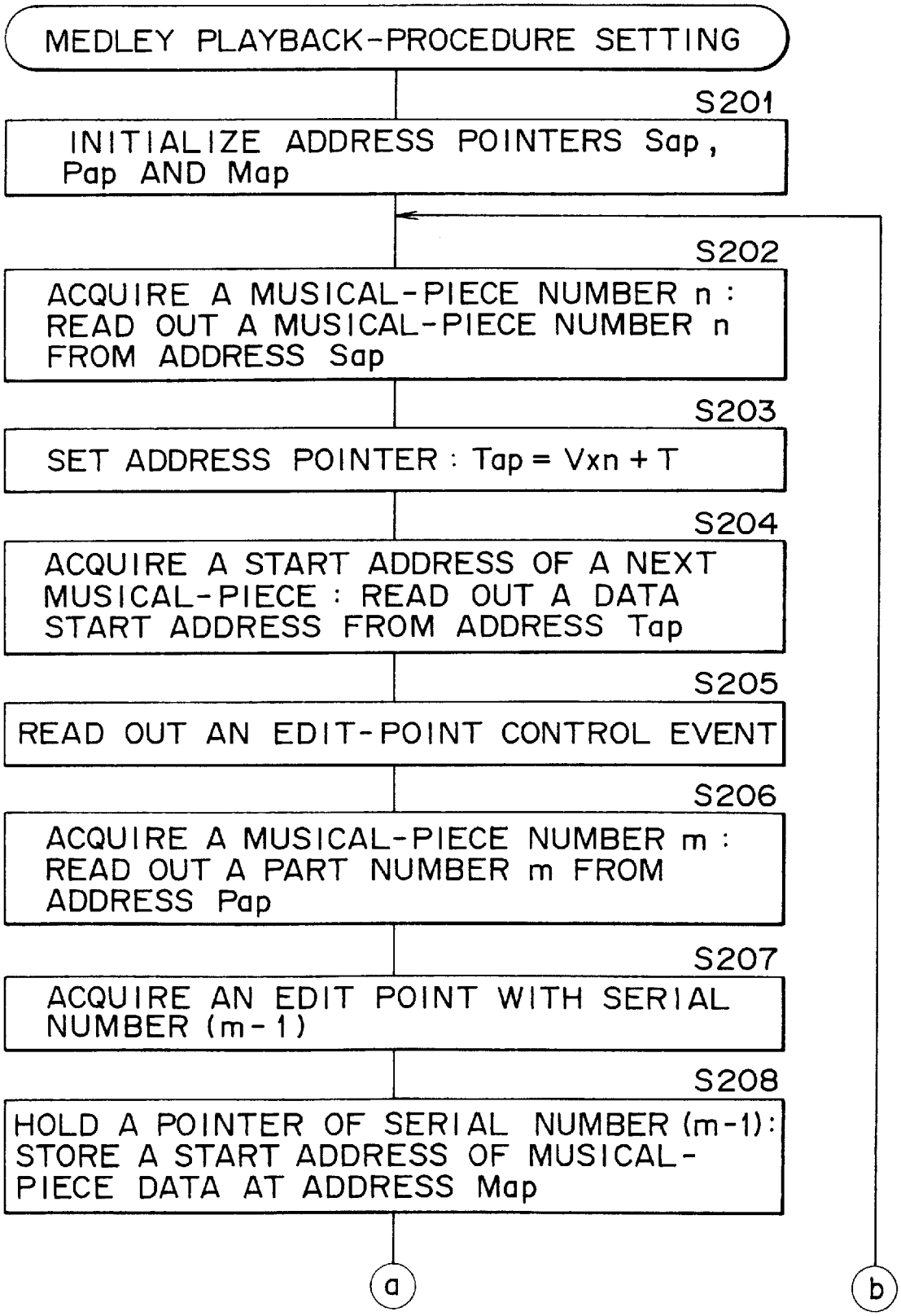
FIGS. 11, 11A and 11B show a flowchart representing a setting procedure for specifying playback musical pieces, playback parts of the specified playback musical pieces composing a medley and a playback-procedure for playing back the medley in accordance with the present invention.
Figure 11B:
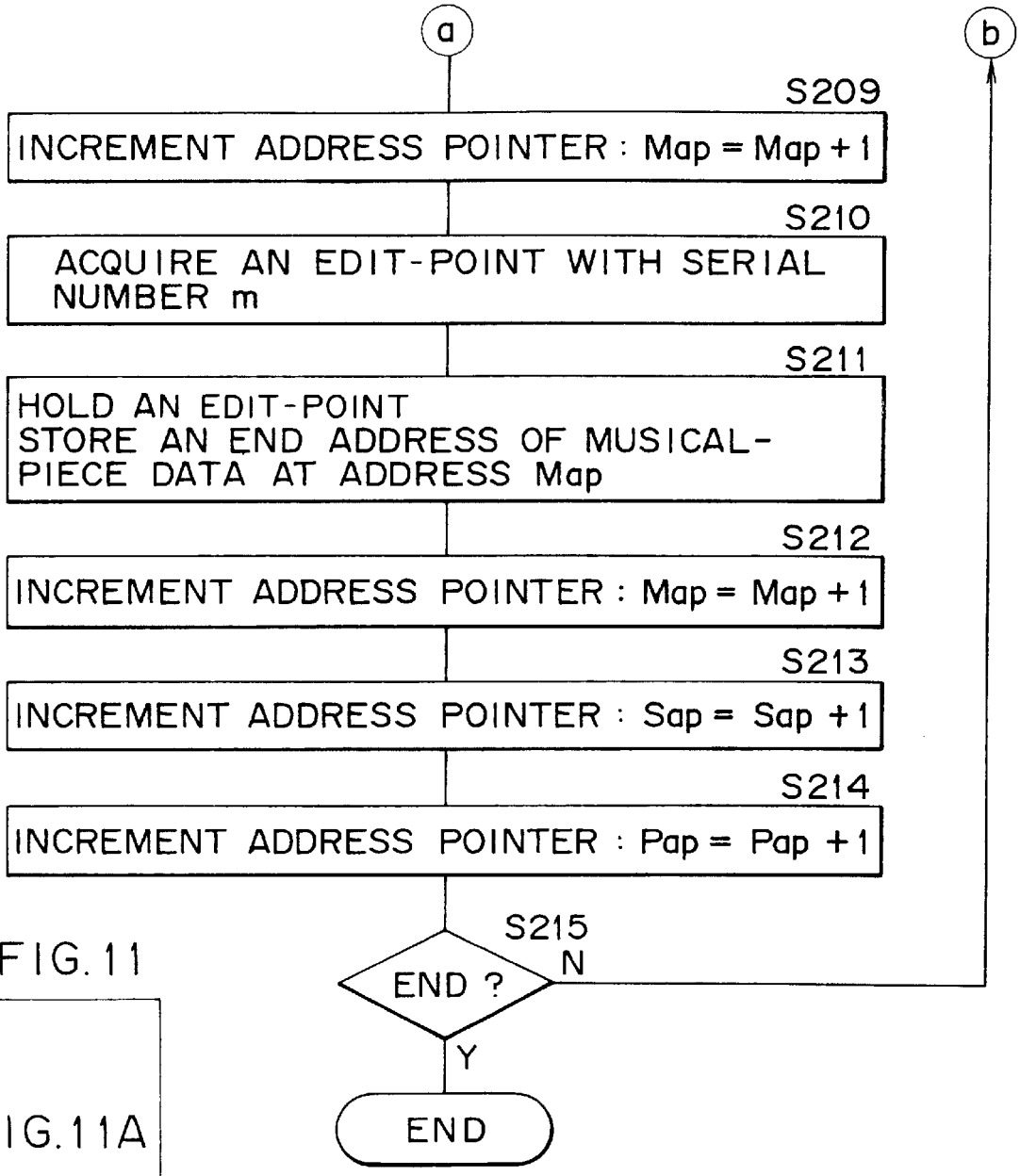
Figure 11:
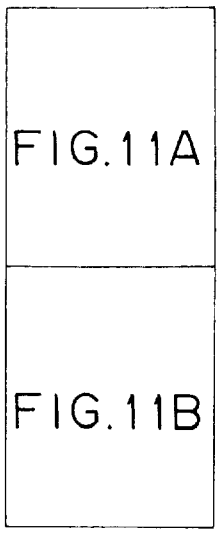

As the processing to set a medley shown in FIG. 10 is completed, the CPU 11 starts carrying out the medley-playback-procedure setting processing shown in FIG. 11.

As shown in FIG. 11, the processing begins with a step S201 at which address pointers Sap, Pap and Map are initialized. The address pointer Map specifies the address in the playback-procedure specifying area.

The flow of the processing then goes on to a step S202 at which a musical-piece number n is acquired in accordance with the order of medley playback-procedure. To put it in detail, the CPU 11 reads out the musical-piece number n stored at an address in the playback-musical-piece specifying area indicated by the current value of the address pointer Sap. The number n is one of S1 to Sn shown in FIG. 9B. Typically, the musical-piece number n is stored in the working memory 13. If the processing of step S202 is carried out for the first time after the medley playback-procedure setting processing is started, the value of musical-piece number S1 of the first musical piece in playback order is stored in the working memory 13 as the musical-piece number n.

Then, the flow of the processing proceeds to a step S203 at which an address pointer Tap pointing to the start-address specifying area for the musical-piece number n acquired at the step S202 is calculated in the course of preparation for acquiring a start address in a data area in which musical-piece data indicated by the musical-piece number n is stored. The address pointer Tap is calculated using the following equation:

$$Tap=T+V\times n$$

where the symbol T is the start address of the start-address specifying area determined in advance, and the symbol V is the number of bytes in the start-address specifying area occupied by a start address for a musical piece. Thus, the address pointer Tap is an address at an offset of (V×n) from the start address T.

Subsequently, the flow of the processing continues to a step S204 at which the start address of musical-piece data is read out from the start-address specifying area indicated by the address pointer Tap calculated at the step S203. The start address of the musical-piece data is stored in the working memory 13. Thus, the start address of musical-piece data indicated by the musical-piece number n is acquired.

The flow of the processing then goes on to a step S205 at which the CPU 11 makes an access to the start address of the musical-piece data indicated by the musical-piece number n acquired at the step S204 to search the musical-piece data for an edit-point control event. The edit-point control event is then extracted from the musical-piece data and stored in the working memory 13. Then, the flow of the processing proceeds to a step S206.

At the step S206, a part number m stored at an address in the playback-part specifying area indicated by the current value of the address pointer Pap is read out from the playback-part specifying area. The information of the part number m, one of P1 to Pn, is then stored in the working memory 13. Subsequently, the flow of the processing continues to a step S207.

At the step S207, processing is carried out to find the position of an edit-point denoting event in which the serial number (m−1) of an edit point is stored. This processing is carried out to acquire the start address of a part identified by the part number m.

As described above, the actual value of the part number of a part is set as (a+1) where the symbol a is the serial number of an edit point denoted by an edit-point denoting event inserted into the head of the part. Thus, the start address of the edit-point denoting event in which the serial number (m−1) of the edit point is stored is the start address of a part identified by the part number m.

Thus, in the processing carried out at the step S207, the relative address of an edit-point denoting event indicated by the edit-point serial number (m−1) is read out from the edit-point control event stored as data in the working memory 13 at the step S205.

The flow of the processing then goes on to a step S208 at which, first of all, the relative address of an edit-point denoting event obtained at the step S207 is added to the recording-position address of the edit-point control event in the musical-piece data identified by the musical-piece number n on the data area to produce an absolute address on the data area.

The value of the absolute address in the data area is equal to the start address of the part identified by the part number m in the musical-piece data n on the data area. This absolute address, that is, the start address of the part identified by the part number t, is then stored in the playback-procedure specifying area at an address pointed to by the address pointer Map.

If the initial part between the head of the file and the position of the first edit-point denoting event (that is, a part identified by a part number of 0) is specified, however, the start address of the initial part is found by typically identifying an address on the data area at which the head of the data section is stored. The address on the data area at which the head of the data section is stored is used as the start address of the initial part.

When the processing of the step S208 is completed, the flow of processing goes on to a step S209 at which the CPU 11 increments the address pointer Map before continuing the processing to a step S210.

At the step S210, the position of an edit-point denoting event in which the edit-point serial number m is stored is identified. The processing of the step S210 is carried out to acquire an address equal to the end address of the part identified by the part number m incremented by one step.

At the step S210, the relative address of an edit-point denoting event indicated by the edit-point serial number m is read out from the edit-point control event stored as data in the working memory 13 at the step S205.

The flow of the processing then goes on to a step S211 at which, first of all, the relative address of an edit-point denoting event obtained at the step S210 is added to the recording-position address of the edit-point control event in the musical-piece data identified by the musical-piece number n on the data area to produce an absolute address on the data area.

The value of the absolute address in the data area is equal to the start address of the part identified by the part number m in the musical-piece data n on the data area incremented by one step. This absolute address is actually the start address of the part identified by the part number (m+1). However, this absolute address is then stored in the playback-procedure specifying area at an address pointed to by the address pointer Map as the end address of the part identified by the part number m.

As a result of the above pieces of processing including the step S211, the start and end addresses of a part to be used in an operation to play back a medley are stored in the playback-procedure specifying area at addresses pointed to by the address pointer Map.

For example, assume that a part identified by the part number P1 in the first musical piece identified by the musical-piece number S1 in the play back order is specified in the processing carried out so far up to the step S211. In this case, the start and end addresses of the part identified by the part number P1 in the musical piece identified by the musical-piece number S1 are stored on the top and second lines of the playback-procedure specifying area respectively as shown in FIG. 9B.

The flow of the processing then goes on to steps S212, S213 and S214 at which the address pointers Map, Sap and Pap are incremented respectively. Then, the flow of the processing proceeds to a step S215.

At the step S215, the CPU 11 forms a judgment as to whether or not the medley playback-procedure setting processing has been completed, that is, whether or not the series of processing of the steps S202 to S214 have been carried out for all parts used as playback order numbers 1 to N. If the outcome of the judgment indicates that the medley playback-procedure setting processing has not been completed, the flow of the processing goes back to the step S202.

When the outcome of the judgment formed at the step S215 finally indicates that the medley playback-procedure setting processing has been completed, the information of start and end addresses of all parts used as playback order numbers 1 to N have all been stored in the playback-procedure specifying area as shown in FIG. 9B in the order of the parts to be played back. The start and end addresses stored as data in the playback-procedure specifying area serve as control data for creating an SMF as a new medley created in accordance with inputs specified by the user.

As described above, during the series of processing shown in FIGS. 10 and 11, the playback-musical-piece specifying area, the playback-part specifying area and the playback-procedure specifying area of the musical-piece memory 21 are used. It should be noted, however, that a playback-musical-piece specifying area, a playback-part specifying area and a playback-procedure specifying area can be set in the working memory 13. In this case, data which corresponds to elapsed process may be written into and read out from the playback-musical-piece specifying area, the playback-part specifying area and the playback-procedure specifying area set in the working memory 13 during the processing.

Then, after the series of processing shown in FIGS. 10 and 11 corresponding to procedures 1 to 3 are carried out, the user carries out an operation to start playing back a medley corresponding to procedure 4. In this case, for example, the CPU 11 reads out start and end addresses of each part stored in the playback-procedure specifying area sequentially one after another in order to execute an operation to playback musical pieces stored in areas of an SMF defined by these start and end addresses.

To put it in detail, the CPU 11 reads out the start address of a part identified by the part number P1 of a musical piece identified by the musical-piece number S1 stored at the beginning of the playback-procedure specifying area and sets a playback address pointer to the start address to start an operation to playback the SMF. Thus, the playback operation begins with the part identified by the part number P1 of the musical piece identified by the musical-piece number S1. As the location of playback data matches the end address of the part identified by the part number P1 of the musical piece identified by the musical-piece number S1, the value of the playback address pointer is changed to the start address of a part identified by the part number P2 of a musical piece identified by the musical-piece number S2 in order to continue the playback operation. This processing to playback the SMF is carried out repeatedly until the location of playback data matches the end address of the last part in the medley identified by the part number Pn of a musical piece identified by the musical-piece number Sn. As a result, processing to play back a medley can be carried out in accordance with what are specified by the user through the operations of procedures 1 to 3.

As described above, in this embodiment, edit processing to create a medley can be carried out in the playback apparatus 0 by referring to simple data and computing addresses associated with the data without developing the format of an SMF into a format unique to the playback apparatus 0.

Also as described above, the playback-musical-piece specifying area, the playback-part specifying area and the playback-procedure specifying area shown in FIG. 9B are used for storing information on one medley of musical pieces. It should be noted, however, that those areas can also be used for storing information on a plurality of musical-piece medleys. In such a case, information on a musical-piece medley is stored after information on an immediately preceding musical-piece medley instead of being written over information on a musical medley stored previously. In this way, the user is capable of readily starting an operation to play back a musical-piece medley by merely selecting the musical-piece medley among a plurality of medleys created in advance.

In addition, according to what is described above, the contents of an edit-point control event inserted as an option are referenced to identify subsequent edit points, that is, positions into which edit-point denoting events are inserted. It is worth noting that, with no edit-point control event inserted, edit-point denoting events can be found one after another by examining the contents of each event found in a search of data of a musical piece starting from the start address thereof. In this way, desired edit points can be identified. Moreover, by properly setting the contents of the edit-point control event, edit points of data of a musical piece can be denoted without actually inserting edit-point denoting events. In this case, the position of the edit points can be identified by referring to the contents of the edit-point control event.

In the embodiment shown in FIG. 7, the work to edit a standard MIDI file is carried out by using the transmission apparatus 9. As an alternative, a standard MIDI file can be transmitted from the transmission apparatus 9 to the playback apparatus 0 by way of the transmission network 8 and stored temporarily in the data storage unit 2 employed in the playback apparatus 0. The user is then allowed to set edit points by operating the operation unit 6. In this way, the user is capable of specifying an interactive musical performance by, for example, carrying out editing work to concatenate an end portion with an introduction portion of a musical piece or editing work to play back a musical performance of only the first movement of a musical piece.

In addition, the edit processing provided by the present invention is not limited to processing to produce a playback medley described above. Instead, the scope of the present invention may include, for example, any edit processing such as cutting off unneeded portions from a piece of musical-piece data, as long as the edit processing is based on edit points.

Moreover, while an SMF is processed in the embodiment as described above, the present invention can also be applied to information on musical pieces and/or musical performances having another format.

As described above, according to the present invention, information such as an edit-point denoting event is inserted into information on musical pieces and/or musical performances as an event data for SMF or the like described by the format of the SMF or the like. The information such as an edit-point denoting event is typically used in a playback apparatus to identify an edit point which is used as a base point for carrying out processing to edit the information on musical pieces and/or musical performances.

That is to say, it is possible to carry out editing work by using the format of the information on musical pieces and/or musical performances as it is without execution of heavy load processing to develop the format of the information on musical pieces and/or musical performances into an entirely different data format. Edit points serving as base points for identifying data segments in the information on musical pieces and/or musical performances are arranged into an array of data for playing back a proper musical piece and/or a musical performance. It is thus possible to always assure a correct musical piece and/or a musical performance based on such a data array obtained even after the editing work.

As a result, it is no longer necessary to provide for example large-scale hardware for developing information on musical pieces and/or musical performances into a unique data format in the configuration of the apparatus for editing the information on musical pieces and/or musical performances. In addition, a load borne by software can be reduced substantially.

In a communication karaoke system using information on musical pieces and/or musical performances such as an SMF, for example, when it is desired to provide a medley of musical pieces arranged as the user likes, according to the present invention, on the host side, pieces of information on edit-point denoting events are merely inserted into information on musical pieces and/or musical performances which is then transmitted to a playback apparatus. Then, on the playback-apparatus side, the user typically specifies a part of each specified musical piece and/or each musical performance and specifies an order to play back the specified parts composing a medley. Each part is created by using edit points each denoted by an edit-point denoting event as base points. The medley is finally played back by reproducing the specified parts in the specified order in a very simple editing process. In this case, since the equipment investment for the communication karaoke system provided by the present invention entails only a considerably low cost, the present invention is extremely useful.

What is claimed is:

1. An editing apparatus for editing information on musical performances by using an electronic musical instrument for carrying out an edited musical performance by mixing tones of a plurality of musical instruments based on said information on said musical performances including:

a plurality of first event commands wherein each first event command consists of an identifier showing a type of one of said musical instruments and a start address of a playing of said musical instrument described by said identifier; and a second event command indicating a start and an end of the playing of the musical instrument described by said identifier in each of said first event commands, said editing apparatus comprising:

an edit-point setting means for setting an edit point at a position of a specific first event command in said information on musical performances;

a position judging means for judging whether the position of the edit point set by said edit-point setting means is described in said second event command; and an event-command adding means for adding a new first event command corresponding to one of said musical instruments to instruct said musical instrument to play music after the edit point if the position of said edit point is judged by said position judging means to be described in said second event command.

2. The editing apparatus according to claim 1 wherein said event-command adding means adds an edit-point denoting event command for the edit point including the start address of the playing of one of said musical instruments to be performed after said edit point.

3. The editing apparatus according to claim 2 wherein said event-command adding means adds an edit-point control event command for controlling said edit-point denoting event command to be inserted thereto.

4. The editing apparatus according to claim 3 for performing the edited musical performance by subsequently concatenating a plurality of parts of said musical performances wherein each of said parts is sandwiched by two consecutive edit points each found by searching said information on said musical performances based on said edit-point control event command.

5. The editing apparatus according to claim 1 wherein said information on said musical performances is stored in a MIDI file.

6. An editing method for editing information on musical performances, comprising the steps of:

using an electronic musical instrument for carrying out an edited musical performance by mixing tones of a plurality of musical instruments based on said information on said musical performances;

using a plurality of first event commands, each consisting of an identifier showing a type of one of said musical instruments and a start address of a playing of said musical instrument described by said identifier;

using a second event command indicating a start and an end of the playing of the musical instrument described by said identifier in each of said first event commands;

an edit-point setting step for setting an edit point at a position of a specific first event command in said information on said musical performances;

a judging step for judging whether the position of the edit point set at said edit-point setting step is described in said second event command; and an event-command adding step for adding a new first event command corresponding to one of said musical instruments to instruct said musical instrument to play music after said edit point if the position of said edit point is judged at said judging step to be described in said second event command.

7. The editing method according to claim 6, further comprising the step of adding an edit-point denoting event command for the edit point including the start address of the playing of one of said musical instruments to be performed after said edit point.

8. The editing method according to claim 7, further comprising the step of adding an edit-point control event command for controlling the position of said edit-point denoting event command.

9. The editing method according to claim 8, further comprising the step of performing the edited musical performance by subsequently concatenating a plurality of parts of said musical performances wherein each of said parts is sandwiched by two consecutive edit points each found by searching said information on said musical performances based on said edit-point control event command.

10. The editing method according to claim 7, further comprising the step of storing said information on said musical performances in a MIDI file.

* * * * *